United States Patent [19]

Huggins

[11] Patent Number: 4,597,570

[45] Date of Patent: Jul. 1, 1986

[54] FEEDABILITY SENSOR FOR A VACUUM CORRUGATED FEEDER WITH MOVABLE BACKSTOP

[75] Inventor: Raymond W. Huggins, Pittsford, N.Y.

[73] Assignee: Xerox Corporation, Stamford, Conn.

[21] Appl. No.: 678,197

[22] Filed: Dec. 4, 1984

[51] Int. Cl.[4] ..... B65H 3/12

[52] U.S. Cl. ..... 271/98; 271/94

[58] Field of Search ..... 271/94, 95, 96, 97, 271/98, 99, 3.1, 4, 5, 104, 105, 106, 35; 355/3 SH, 14 SH, 48, 50

[56] References Cited

U.S. PATENT DOCUMENTS

| | | | |
|---|---|---|---|
| 4,269,406 | 5/1981 | Hamlin | 271/108 |
| 4,270,746 | 6/1981 | Hamlin | 271/98 |
| 4,284,270 | 8/1981 | Silverberg | 271/166 |
| 4,336,928 | 6/1982 | Smith et al. | 271/3.1 |
| 4,336,929 | 6/1982 | Hanzlik | 271/20 |
| 4,397,459 | 8/1983 | Silverberg et al. | 271/105 X |

*Primary Examiner*—Bruce H. Stoner, Jr.
*Assistant Examiner*—Matthew C. Graham
*Attorney, Agent, or Firm*—Ronald F. Chapuran

[57] ABSTRACT

A system for measuring the coefficient of friction between the bottom two sheets of the stack. The vacuum corrugation feeder tray is rigidly mounted and supports a stack of sheets resting at one end of the tray against a movable backstop. An air knife provides air pressure between the bottom sheet from the rest of the stack. The stack of sheets is forced up the tray by the backstop and allowed to slide back down the tray when the backstop is moved. The coefficient of friction between the stack and the bottom sheet is determined by the acceleration of the stack as it moves back down the tray. The coefficient of friction is then used to control the amount of air pressure from the air knife until an optimum coefficient of friction is achieved.

8 Claims, 9 Drawing Figures

FEEDABILITY SENSOR FOR A VACUUM CORRUGATED FEEDER WITH MOVABLE BACKSTOP

This invention relates to document and sheet feeders and, in particular, to a sensor for a vacuum corrugation feeder using a fixed tray and a movable backstop supporting the sheets in the tray.

In the use of high speed xerographic reproduction machines, there is a need for document handlers and sheet feeders to feed documents and sheets in a rapid dependable manner. The document and sheet feeders must operate flawlessly to eliminate the risk of damaging the documents and sheets and to minimize machine shutdowns due to uncorrectable misfeeds or document multifeeds. Of prime concern is the initial separation of the individual documents or sheets from the sheet or document stack.

In a document handler, the documents must be suitably handled to insure separation without damage through a number of cycles. Suggested separators have included friction rolls or belts used for positive document feeding in conjunction with a retard belt, pad or roll to prevent multifeeds. Vacuum separators such as sniffer tubes, rocker type vacuum rolls, or vacuum feed belts have also been used.

While the friction roll-retard systems are very positive, the action of the retard member, if it acts upon the printed face of a document can cause smearing or partial erasure of the printed material. The problem is very difficult to control with two-sided documents. In addition, the reliable operation of friction retard feeders is highly dependent on the relative frictional properties of the paper being handled.

In document handlers where the document set may be circulated many times, the document handler is normally provided with a bottom sheet separator-feeder to allow feeding of documents while documents which have already been copied are returned to the top of the document stack. In this way, after all the documents have been copied they are in correct order to recirculate, if necessary.

One of the major problems with bottom sheet feeders is that without knowing how large a stack of documents is to be placed in the feed tray or the paper weight of the individual documents, it is difficult to design a sheet separator that is gentle enough for small stacks or light weight paper and still capable of handling large stacks or heavy weight paper.

Attempts to overcome this problem include U.S. Pat. No. 4,269,406 disclosing a vacuum corrugating feeder wherein the design of the document tray, the orientation of the vacuum separator belts, the design and orientation of the air knife, the use of a single blower to provide subatmospheric and atmospheric air pressure for the vacuum separator belts and the air knife, and the air flow control valve all combine to provide a sheet separator that is relatively insensitive to the variation in document stack size or paper weight. However, it has been found that with extremely stiff documents, the document may not be held on the feed belt securely enough to insure consistent document feed, thereby resulting in the possibility of a misfeed.

To overcome this problem, U.S. Pat. No. 4,336,929 teaches a sheet feeder for separating and feeding the bottom sheet in a stack including a plurality of vacuum feed belts spaced from the bottom surface of the document stack. Corrugating means associated with the vacuum feed belts are adapted to hold the sheet acquired by the vacuum feed belts in a non-planar condition to provide a corrugation in the acquired sheet. The corrugating means are biased in an upward direction such that light weight sheets have insufficient beam strength to deflect the corrugating means in a downward direction, thereby providing maximum corrugation in the sheet while heavy weight sheets are adapted to force the corrugating means downward, thereby providing less corrugation to the sheet while at the same time allowing the sheet to more closely approach the vacuum openings in the vacuum feed belts for adequate aquisition of the sheet.

Other attempts to solve the problems associated with bottom of the stack sheet feeders are taught in U.S. Pat. Nos. 4,270,746 and 4,284,270. The '270 patent teaches a plurality of vacuum feed belts spaced from the bottom surface of the document stack, the sheet stack being supported on a stack tray having a "U" shaped pocket form therein. The vacuum from the feed belts causes a portion of the bottom sheet in the stack to be pulled into the pocket for contact with the vacuum belts. The '746 patent teaches the use of an air knife to produce a plurality of air streams directed downwardly toward the lead edge of the bottom sheet. The knife is located relative to the lead edge of the sheet stack and a vacuum feeder belt assembly to provide optimum performance irrespective of curl encountered in the sheets being fed.

A general problem with bottom feed document handlers is the providing of the correct air flow from an air knife to compensate for various paper thicknesses or stiffness. With a very small stack of documents, excessive air flow will cause excessive document flutter or, in the extreme, actually flow documents out of the document tray. With a large stack of documents, insufficient air will not produce the required air pressure of separation between the sheet resulting in misfeeds or multifeeds. One method of compensating for this difficulty is shown in U.S. Pat. No. 4,336,928. In particular, the number of documents in the document stack during the first circulation is counted. If the number of documents in the stack is above a preselected number, an increased amount of air is supplied to the air knife. U.S. Pat. No. 4,269,406 discloses a means to automatically compensate for variable weight sheets.

It is also known to control air knife pressure by measuring the height of the document stack. An initial air knife pressure setting was determined by the height of the stack followed by a reduction during feeding at a predetermined rate based on copy count. Other attempts to control the air knife pressure used a sensor to measure the air pressure in an air pocket underneath the stack.

A difficulty with the prior art attempts at vacuum corrugation feeding was that the reliable operation of the feeder generally depends upon the optimization of the air knife pressure. If the pressure is too low, the area of the air bearing formed between the bottom and next to bottom sheets will be less than the area of the sheet, and a considerable contact area between the sheets will exist. If an attempt is made to feed the bottom sheet, then possibly the next to bottom sheet and maybe many more sheets would be dragged out by the bottom sheet, resulting in a misfeed. On the other hand, if the air pressure is too high, excessive flutter of the sheets will occur, and if the stack comprises only a few sheets, these sheets may be blown away. The optimum air knife pressure for a one inch stack of paper will obviously be much greater than that for only a few sheets. It follows that after the initial optimization of the air knife pressure, the pressure must be reduced as a stack of paper is fed.

It is, therefore, an object of the present invention to provide a reliable means to control the air knife pressure in a vacuum corrugation feeder. It is another object of the present invention to provide a simple, and economical low powered means to operate a vacuum corrugation feeder that minimizes noise levels.

It is another object of the present invention to provide a movable backstop to support a stack of sheets in a tray to be able to measure the coefficient of function between the bottom sheet of the stack and the rest of the stack.

Briefly, the present invention is a system for measuring the coefficient of friction between the bottom two sheets of the stack. The vacuum corrugation feeder tray is rigidly mounted and supports a stack of sheets resting at one end of the tray against a movable backstop. An air knife provides air pressure between the bottom sheet from the rest of the stack. The stack of sheets is forced up the tray by the backstop. The bottom sheet is held in place, and the rest of the stack is allowed to slide back down the tray when the backstop is moved. When the coefficient of friction between the second sheet and the bottom sheet is less than the tangent of the tray angle with respect to the horizontal, the stack will slide down the tray. The friction between the stack and the bottom sheet is determined by the acceleration of the stack as it moves back down the tray. The coefficient of friction is then used to control the amount of air pressure from the air knife until an optimum coefficient of friction is achieved.

Other objects and advantages of the present invention will become apparent upon reading the following detailed description and upon reference to the drawings wherein the same reference numerals have been applied to like parts and wherein.

Figure 7:
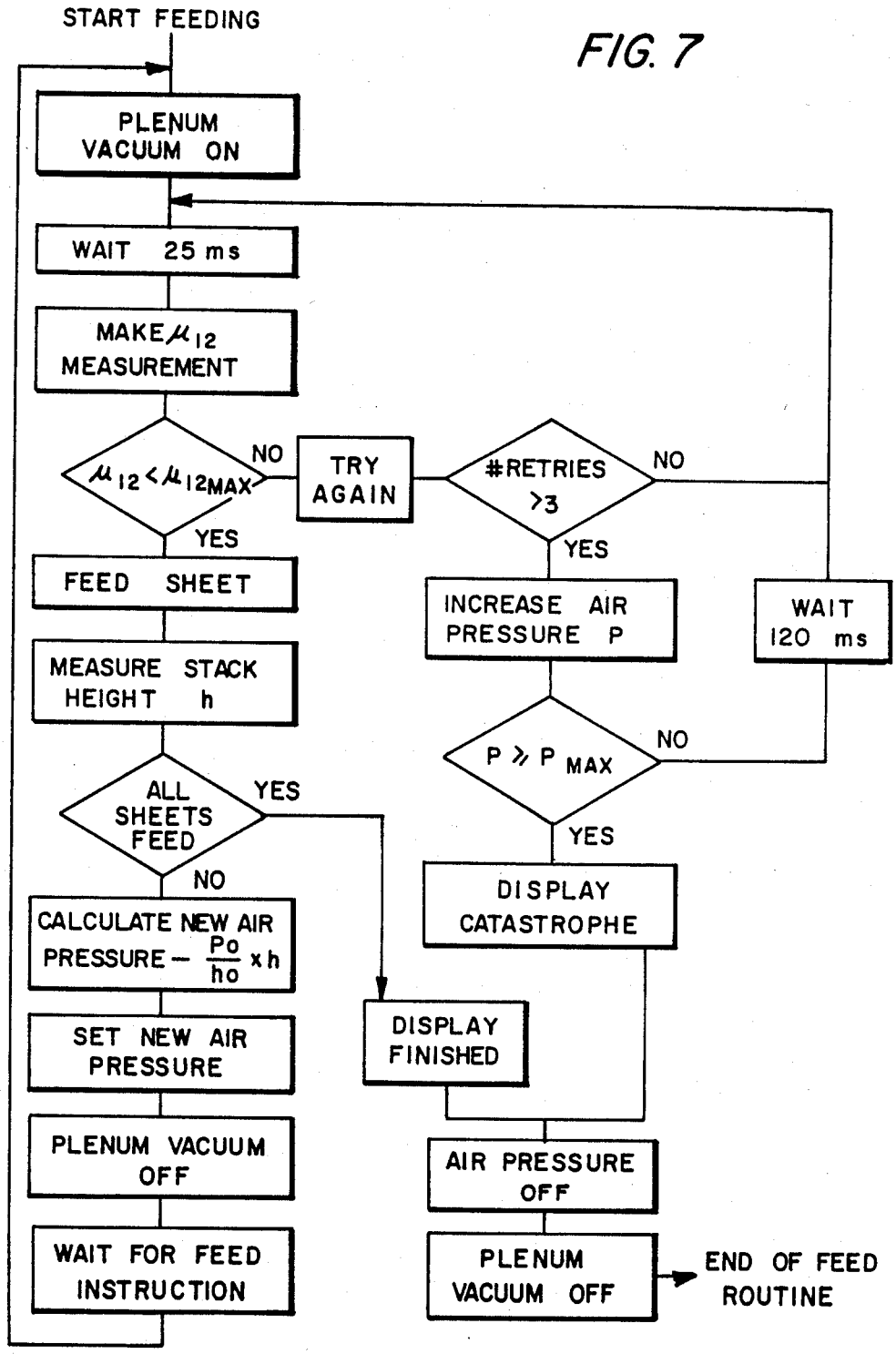

FIGS. *6a* and *6b* is a flow chart of the air knife pressure ramp up;

FIG. 7 is a flow chart of the feed routine; and

Figure 8:
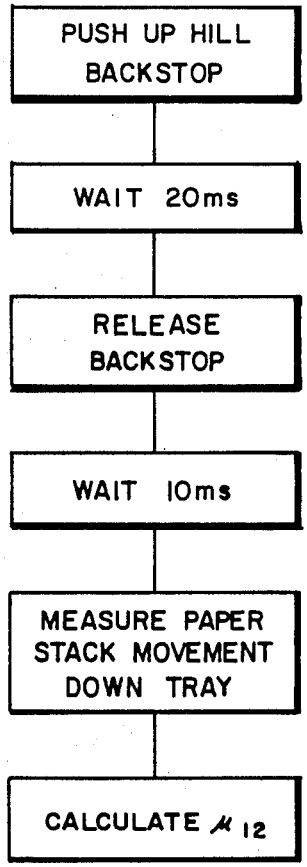

FIG. 8 is a flow chart of the friction measurement.

Referring to the drawings, there is illustrated an automatic document handler 1 for installation above the exposure platen 3 of a xerographic reproduction machine. The document handler is provided with a document tray 5 adapted for supporting a stack of documents 7. A vacuum belt corrugating feeder mechanism 9 is located below the document tray for acquiring and corrugating the bottom document in the stack and forwarding the document to take away roll pair 11 after an air knife 12 has had time to elevate the rest of the stack from sheet 1. The document is then fed by take-away roll pair 11 through document guide 13 to feed roll pair 15 and under platen belt 17 onto the platen of the copy machine for reproduction.

After exposure of the document, it is fed off the platen by belt 17 into guide 19 and feed roll pairs 21 and 23 either to an inverter mechanism 25 or back to the document stack through the feed roll pair 27. A divertor 29 is provided to divert the document either to the inverter or to the feed roll pair 27. The inverter comprises a three roll arrangement 31 and a closed inverter pocket 33.

Figure 1:
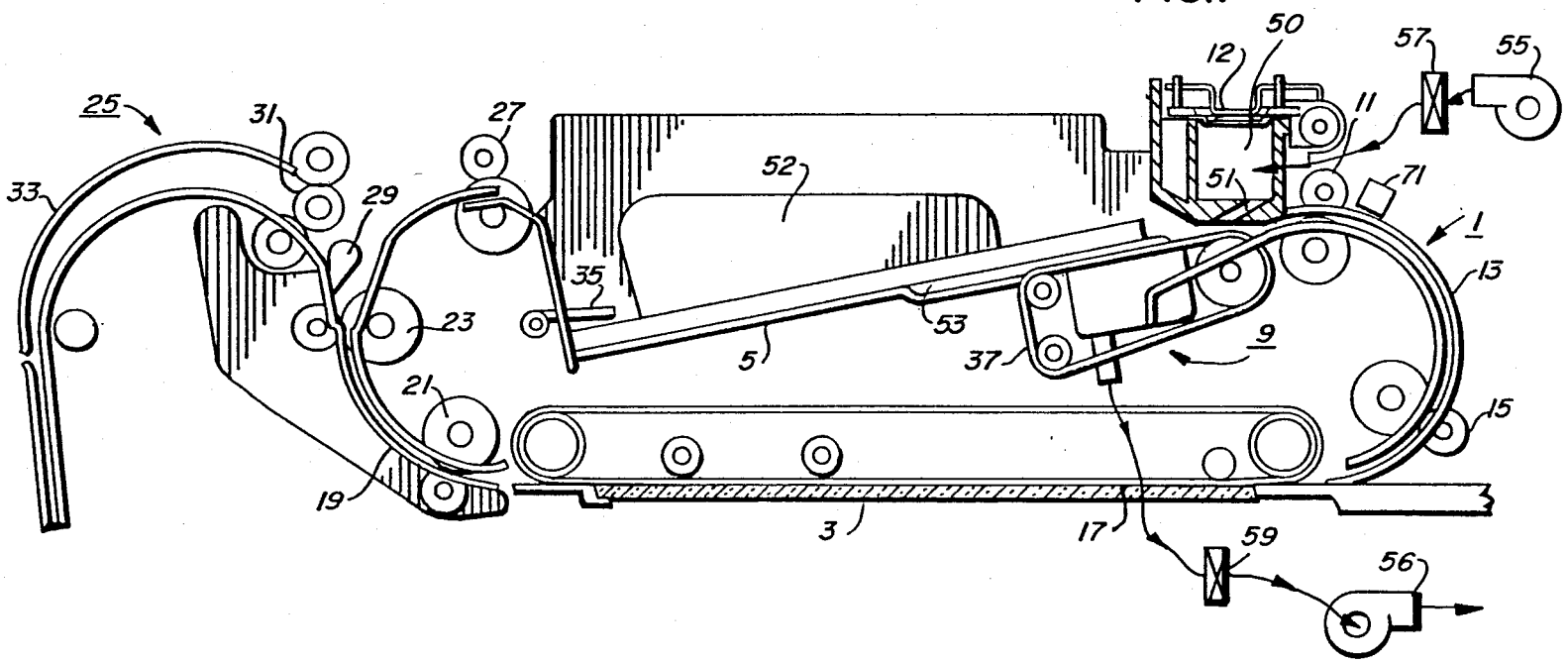
FIG. 1 is a cross-sectional view of an exemplary document handler for practicing the method of the present invention.
Figure 2:
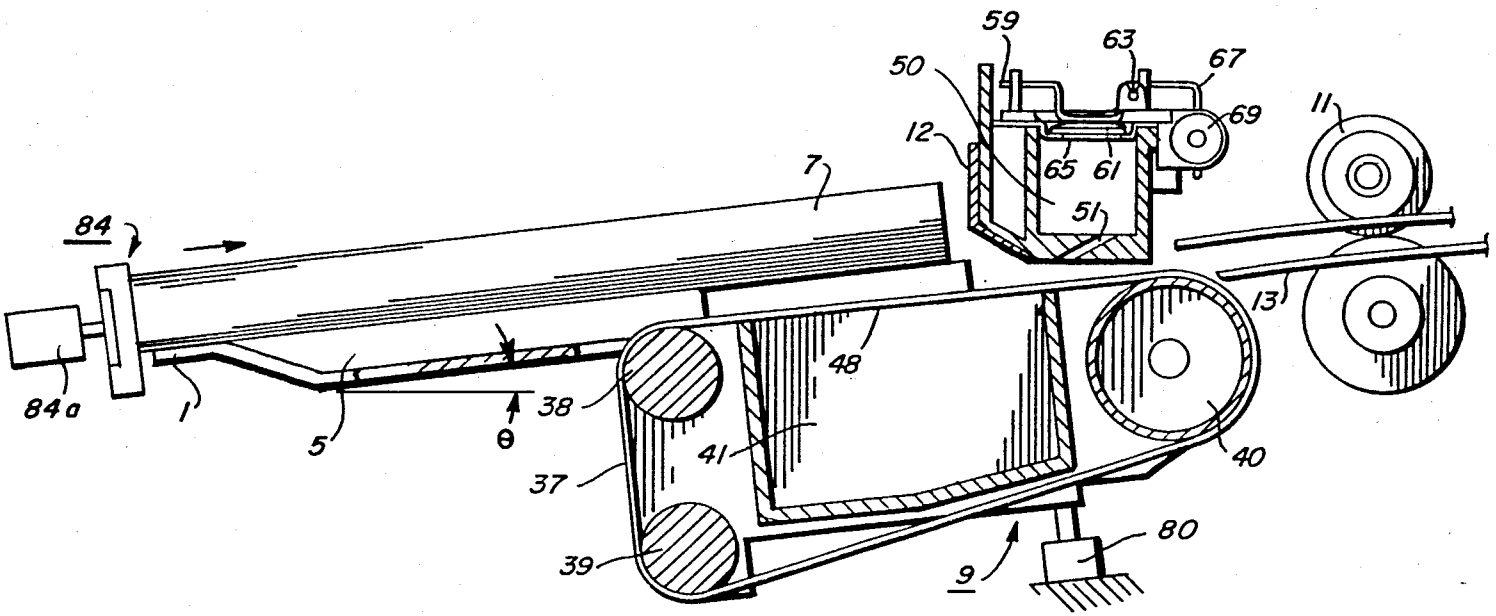
FIG. 2 is an enlarged, cross-sectional view of the separator-feeder portion of the document handler of FIG. 1.
Figure 3:
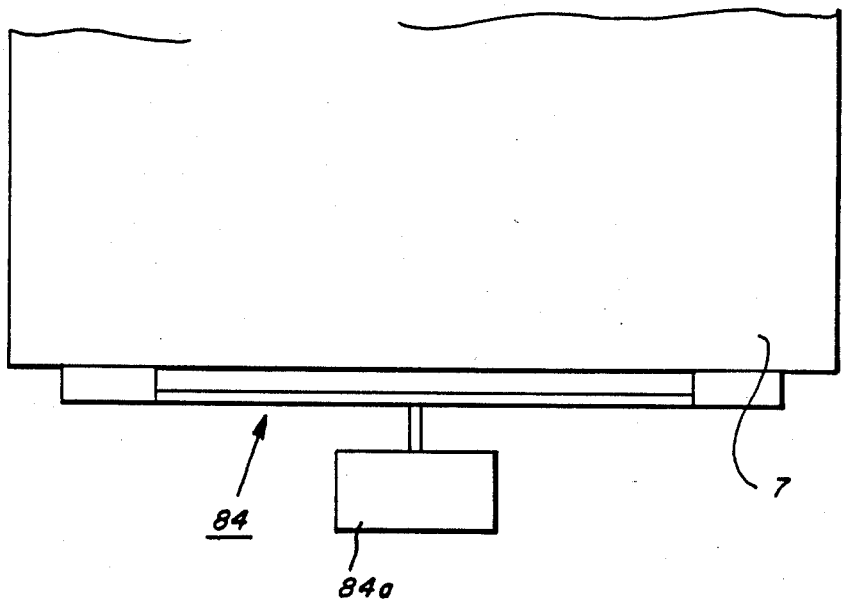
FIG. 3 is a top plan view of the backstop actuator shown in FIG. 2.
Figure 4:
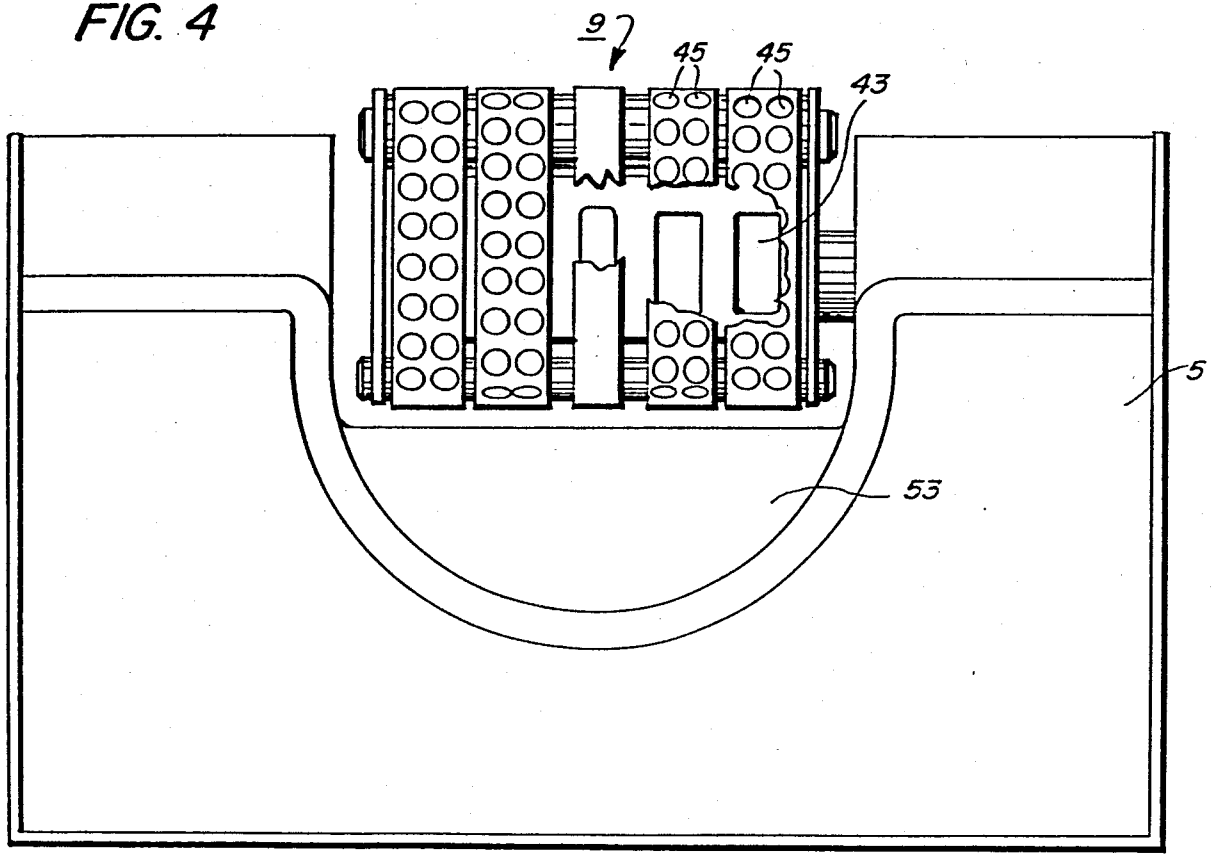
FIG. 4 is a top view of the document tray and feed belts of the document handler illustrated in FIG. 1.

Referring more particularly to FIGS. 2 and 4 wherein the document separator feeder is more clearly illustrated, there is disclosed a plurality of feed belts 37 supported for movement on feed belt rolls 38, 39 and 40. Spaced within the run of the belts 37 there is provided a vacuum plenum having openings 43 therein adapted for cooperation with perforations 45 in the belts 37 to provide a vacuum for pulling the bottom document in the document stack onto the belts 37. As can be seen from FIG. 2, the belts are below the surrounding support surfaces. Thus, the document is corrugated thereby. In the unlikely event that more than one document is pulled down ito contact with the feed belts, the beam strength of the second document resists the corrugating action, thus gaps are opened between sheets one and two which extend their lead edges. These gaps and channels reduce the vacuum levels between sheets one and two due to porosity in sheet one and provide for entry of the separating air flow from the air knife 12. The air knife 12 comprised of pressurized air plenum 50 having a plurality of air jet openings 51 is provided to inject air into the pocket formed between the document pulled down against the feed belt and the documents thereabove to provide an air cushion or bearing between the stack and the bottom document to minimize the force necessary for removing the bottom document from the stack. It can be understood that if two documents are pulled down toward the belts 37, since the top sheet would not be corrugated, the air knife would inject air into the space between the two documents and force the second document off from the raised belt back toward the document stack.

By reference to FIGS. 1, 2, 3 and 4 it can be seen that the document tray 5 is provided with a depressed portion or pocket 53 behind the feed belt assembly. This pocket serves a number of purposes. First, space is provided for the forward potion of the bottom document to be pulled down onto the feed belt assembly. When the bottom document is pulled into this space and corrugated, an envelope type opening or pocket is created between the bottom sheet and the remainder of the sheets in the stack. Air injected into this space from the air knife produces an air bearing between the bottom sheet and the remainder of the stack to allow removal of the bottom sheet from beneath the stack. Flow of air from the pocket is restricted by the partial seal or flow restriction caused by supporting the major portion of the stack weight on the edge portions of the tray surrounding the pocket. It can be seen that blower unit 55 is used to provide pressurized air to air knife 12. A valve 57 is provided in the inlet line to blower 55. A second blower 56 with valve 59 creates a vacuum to pull down the bottom sheet onto vacuum plenum 41.

In one embodiment, paper is placed on the stationary tray 5 resting against a movable backstop illustrated at 84 in FIG. 2. In operation, the bottom sheet is held by the vacuum plenum and the movable backstop 84 pushes the remainder of the stack up the tray in the direction of the arrow in FIG. 2 and the backstop quickly pulled back to its original position. A determination is then made of the distance moved by the sheets sliding back down the tray in a given time. If the coefficient of friction between the bottom sheet and the rest of the stack is greater than tan $\theta$, the sheets in the stack will remain in place, not sliding back down the tray.

If, on the other hand, the coefficient of friction between the bottom sheet and the rest of the stack is less than tan $\theta$, the sheet stack will slide back down the tray until it reaches the backstop 84. The amount of time for the sheet stack to slide back down the tray indicates the coefficient of friction between the bottom sheet and the rest of the stack. The stack motion is sensed by any suitable motion sensor.

It is assumed that the stack is initially pushed up the tray by the backstop 84 and then either remains stationary or moves down the tray. When the coefficient of friction $\mu_{12}$ is less than or equal to the tangent of the angle $\theta$ of the tray with respect to the horizontal (see FIG. 2), i.e. $\mu_{12} \leqq \tan\theta$, the stack of paper moves, and information about $\mu_{12}$ and the mass of paper may be found as follows:

MOVING BACKSTOP-SINUSOIDAL MOTION ($\mu_{12} < \tan\theta$)

CASE 1

The sheets are not in contact with the backstop throughout the complete cycle. In this case, when the backstop is moving down the plane, it will, at some point, move faster than the paper. If the points of the cycle where contact with the stack is lost and remade can be identified, the $\mu_{12}$ may be estimated from elementary mechanics.

CASE 2

The sheets are in contact with the backstop throughout the cycle, with the stack moving up and back. Here, the force on the backstop will be complex. In general, the in-phase component of the force relative to the motion will be a function of the losses in the oscillatory motion, and the out of phase components will be a function of the inertia or mass of the system. Hence both $\mu_{12}$ and the mass of the paper may be found from the magnitude backstop driving force, and phase of the backstop driving force relative to the backstop motion.

MOVING BACKSTOP-IMPULSIVE MOTION

Figure 5:
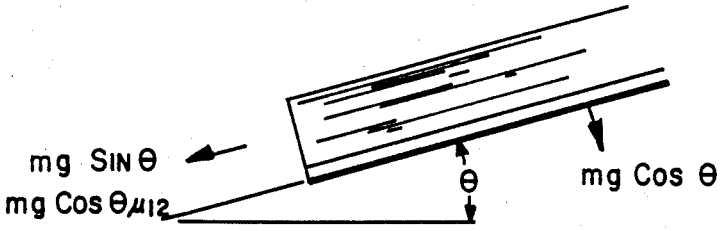
FIG. 5 illustrates the forces acting on the paper stack resting on an inclined tray.

The backstop actuator 84*a* is excited with a pulsed waveform. The backstop is suddenly moved down the plane and the motion of the stack is observed. Provided that $\mu_{12} \leqq \tan\theta$, the motion of the stack is that of a body sliding down an inclined plane from rest with the frictional force tending to reduce the acceleration of the body. Mathematically, the forces acting on the paper stack are shown in FIG. 5 and are:

$$F = mg \sin\theta - \mu_{12}\, mg \cos\theta$$

The acceleration down the slope is:

$$A = F/m = g(\sin\theta - \nu_{12}\cos\theta)$$

The distance from rest moved in a time t is:

$$s = \frac{1}{2}At^2 = \frac{gt^2}{2}(\sin\theta - \mu_{12}\cos\theta)$$

-continued or $$\mu_{12} = \tan\theta - \frac{2s}{g\cos\theta}\cdot t^2$$

This simple result forms the basis of a system which has been developed for measuring $\mu_{12}$ on a VCF vacuum corrugated feeder test fixture. Typical values of $\theta$, t, $\mu$ and s are $\theta = 9°$, t = 10 msec., $0.05 < \mu_{12} < 0.13$, and 0.06 mm < s < 0.017 mm Motion of the stack may be sensed by any linear motion sensor.

Figure 6A:
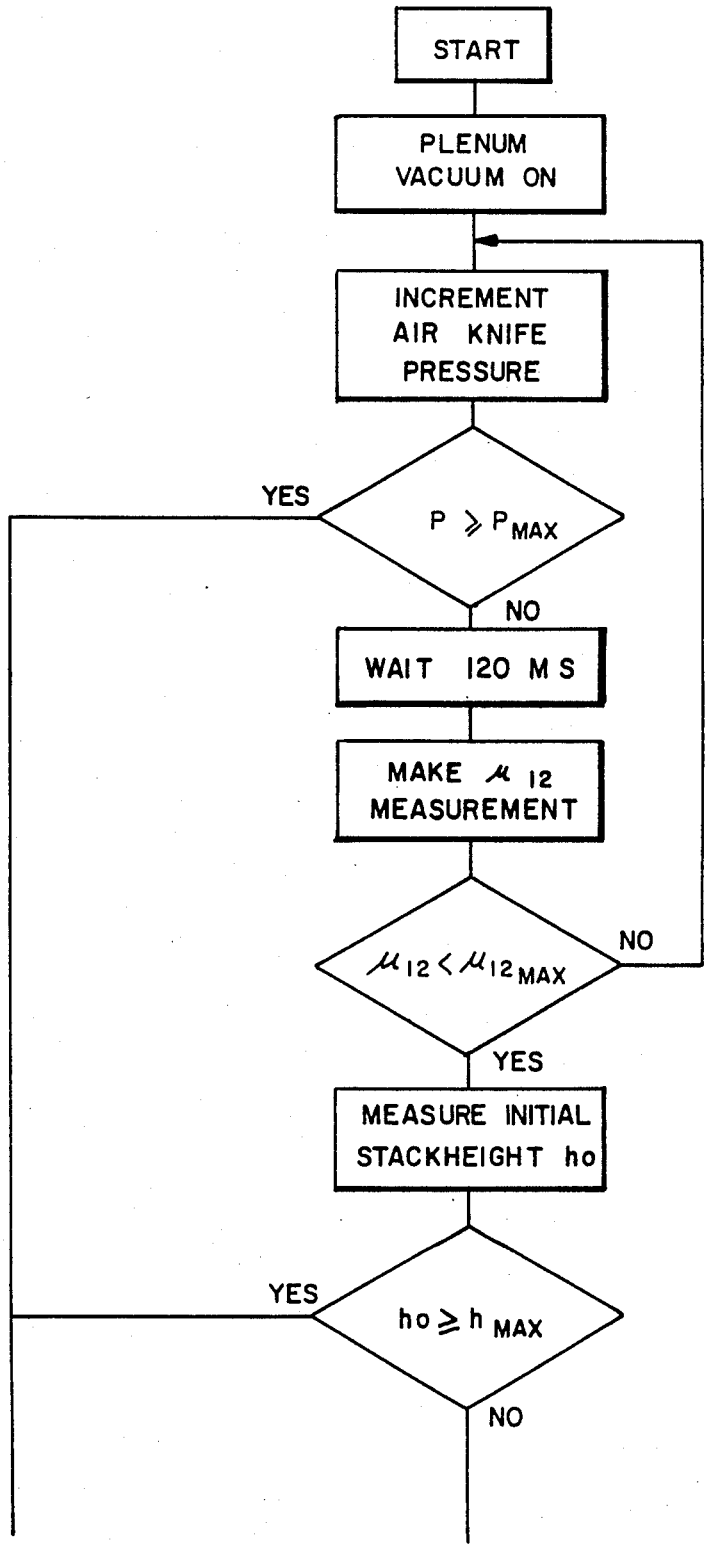
Figure 6B:
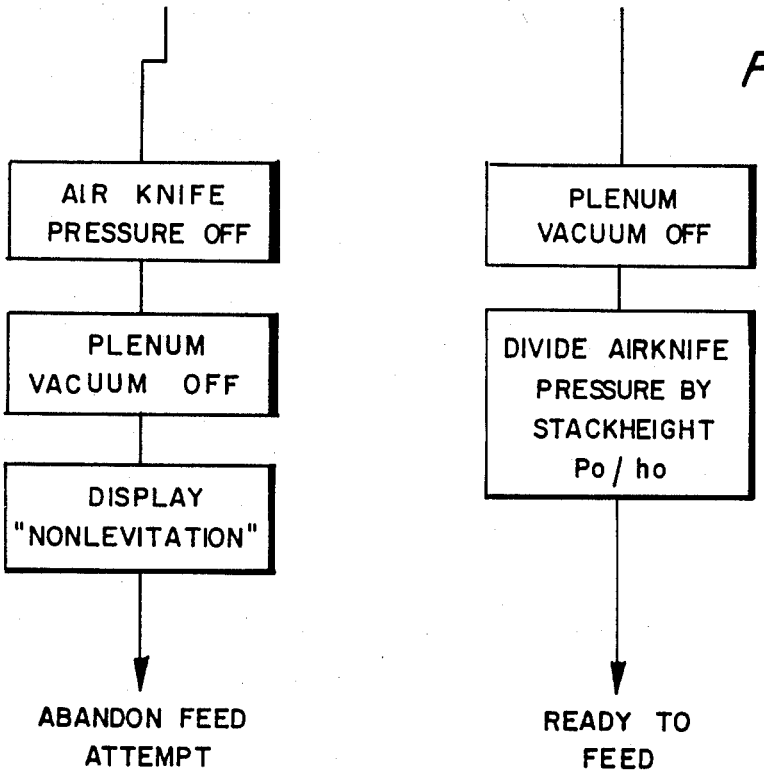

The control algorithm for the air knife pressure control based on the coefficient of friction measurement is divided into two parts—the air knife pressure ramp up, and the control during feeding. For air knife pressure ramp up, with reference to FIG. 6, the bottom sheet is pulled down onto the vacuum plenum. The air knife pressure is then incremented by a predetermined amount.

The coefficient of friction between sheets 1 and 2, $\mu_{12}$, is then measured (see FIG. 8). If $\mu_{12}$ is greater than a predetermined value, the air knife pressure is incremented. The program loops around until $\mu_{12}$ is less than the predetermined value or until the air knife pressure P reaches its maximum value, $P_{max}$. If the $\mu_{12} < \mu_{12max}$ condition is satisfied, the initial stack height $h_o$ is measured. If the initial stack height is greater than a predetermined value, the ramp is aborted, otherwise the ratio of air knife pressure to stack height calculated, and the program advances to the feed routine. If $P = P_{max}$, before the $\mu_{12} < \mu_{12max}$ condition is satisfied, it means the bottom sheet cannot be fed due to either stressed paper or too big a stack, and the ramp up attempt is aborted.

For the feed Routine, with reference to FIG. 7, before feeding sheet 1, $\mu_{12}$ is always measured. If the condition $\mu_{12} < \mu_{12max}$ satisfied, sheet 1 is fed out. After sheet 1 had been fed out, the stack height h is measured and a reduced value of the air knife pressure calculated from $$P = (P_o/h_o) \times h$$

The new air knife pressure is set and the program waits for the instruction to feed the next sheet.

If the condition $\mu_{12} < \mu_{12max}$ is not satisfied, the program will make an arbitrary number (in this example, three) of additional measurements of $\mu_{12}$ (allows the stack to settle). If after a re-measurement the condition $\mu_{12} < \mu_{12max}$ is satisfied, the program procedes normally. If the condition $\mu_{12} < \mu_{12max}$ is still not satisfied after three additional measurements, the program increments the air pressure P and makes another $\mu_{12}$ measurement. The program continues to loop, incrementing P until either the conditon $\mu_{12} < \mu_{12max}$ is satisfied, after which the program will procede normally, or until $P \geqq P_{max}$ after which the attempt to feed is aborted.

With reference to FIG. 8, the friction measurement control algorithm is a fail safe algorithm in that it will not attempt to feed sheet 1 if the condition $\mu_{12} < \mu_{12max}$ is satisfied. This guards against a single sheet in the middle of the stack which is badly stressed, etc.

A proportional method of reducing P based on the initial height of the stack $h_o$ and initial air knife pressure $P_o$ was chosen. This method was more satisfactory than averaging $\mu_{12}$ and increasing or decreasing P depending upon the value of $\mu_{12}$.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

I claim:

1. In a vacuum corrugation sheet feeder system having an air knife to provide air pressure to separate a bottom sheet from the remainder of the sheets in the stack in a sheet feeder tray, the sheets resting against a movable backstop, the method of controlling the air pressure comprising the steps of:

moving the backstop to drive said remainder of the sheets in the stack up the feeder tray allowing the stack of sheets to move down the feeder tray, determining the coefficient of friction beween the bottom sheet and the remainder of the sheets in the stack, and controlling the amount of air pressure from the air knife until a predetermined coefficient of friction is achieved.

2. The method of claim 1 including the step of determining the acceleration of said remainder of the sheets in the stack down the feeder tray.

3. The method of claim 1 including the step of determining the time of movement of said remainder of the sheets in the stack down the feeder tray.

4. The method of claim 1 wherein said remainder of the sheets in the stack are in contact with the backstop as the sheets move down the feeder tray.

5. The method of claim 1 wherein said remainder of the sheets in the stack are out of contact with the backstop as the sheets move down the feeder tray.

6. The method of claim 1 wherein said remainder of the sheets in the stack are intermittently in contact with the backstop as the sheets move down the feeder tray.

7. A method for controlling the operation of a sheet feeder having air flotation means, the sheet feeder including a tray supporting a bottom sheet and a stack of additional sheets resting against a backstop comprising the steps of:

driving said additional sheets up the tray by the backstop, directing the air from the air flotation means between the bottom sheet and the additional sheets in the tray, releasing said additional sheets from contact with the backstop, determining the coefficient of friction between, the bottom sheet and the stack of additional sheets, and adjusting the air discharged from said air flotation means until a predetermined coefficient of friction between the bottom sheet and the stack of additional sheets is achieved.

8. A method according to claim 7 wherein the step of adjusting the air discharged from the air flotation means is accomplished by bleeding air from the air flotation means when less air is required thereby.

* * * * *